US010253608B2

(12) United States Patent
Batarseh et al.

(10) Patent No.: US 10,253,608 B2
(45) Date of Patent: Apr. 9, 2019

(54) DOWNHOLE HEAT ORIENTATION AND CONTROLLED FRACTURE INITIATION USING ELECTROMAGNETIC ASSISTED CERAMIC MATERIALS

(71) Applicant: Saudi Arabian Oil Company, Dhahran (SA)

(72) Inventors: Sameeh Issa Batarseh, Dhahran (SA); Victor Hilab, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 239 days.

(21) Appl. No.: 15/458,706

(22) Filed: Mar. 14, 2017

(65) Prior Publication Data

US 2018/0266226 A1 Sep. 20, 2018

(51) Int. Cl.

| | |
|---|---|
| ***E21B 43/26*** | (2006.01) |
| ***E21B 36/04*** | (2006.01) |
| ***E21B 43/267*** | (2006.01) |
| ***E21B 43/04*** | (2006.01) |
| *E21B 43/24* | (2006.01) |

(52) U.S. Cl.

CPC ..... *E21B 43/26* (2013.01); *E21B 36/04* (2013.01); *E21B 43/04* (2013.01); *E21B 43/267* (2013.01); *E21B 43/2401* (2013.01)

(58) Field of Classification Search

CPC ..... E21B 43/267; E21B 43/26; E21B 43/04; E21B 43/281; E21B 36/04; E21B 36/00; E21B 43/2401

See application file for complete search history.

(56) References Cited

U.S. PATENT DOCUMENTS

| | | | |
|---|---|---|---|
| 6,360,819 | B1 | 3/2002 | Vinegar |
| 8,408,294 | B2 | 4/2013 | Bridges et al. |
| 9,140,099 | B2 | 9/2015 | Parsche |
| 9,399,906 | B2 | 7/2016 | Parsche |
| 2012/0012319 | A1 | 1/2012 | Dennis |

(Continued)

FOREIGN PATENT DOCUMENTS

| | | |
|---|---|---|
| CA | 2592491 | 11/2007 |
| EP | 2644822 A2 | 10/2013 |

(Continued)

OTHER PUBLICATIONS

International Search Report and Written Opinion for International Application No. PCT/US2018/022228, dated Jun. 21, 2018 (pp. 1-13).

*Primary Examiner* — Michael R Wills, III

(74) *Attorney, Agent, or Firm* — Bracewell LLP; Constance G. Rhebergen; Linda L. Morgan

(57) ABSTRACT

A fracturing assembly for forming fractures in a subterranean formation includes a source tool having a rotational joint moveable to orient the source tool in a range of directions and a directional electromagnetic antenna having an electromagnetic wave source. A ceramic-containing member is located within a distance of the electromagnetic antenna to be heated to a fracture temperature by electromagnetic waves produced by the electromagnetic wave source. The ceramic-containing member is positionable to orient a fracture in the subterranean formation at the fracture temperature.

20 Claims, 4 Drawing Sheets

(56) References Cited

U.S. PATENT DOCUMENTS

| | | | | |
|---|---|---|---|---|
| 2012/0205109 | A1* | 8/2012 | Burnham | E21B 43/243 166/302 |
| 2013/0213637 | A1 | 8/2013 | Kearl | |
| 2014/0090834 | A1 | 4/2014 | Sultenfuss et al. | |
| 2014/0305640 | A1 | 10/2014 | Wellington et al. | |
| 2015/0021013 | A1* | 1/2015 | Batarseh | E21B 43/24 166/248 |
| 2015/0322759 | A1* | 11/2015 | Okoniewski | H01Q 1/04 166/60 |
| 2015/0354333 | A1 | 12/2015 | Kasevich et al. | |
| 2016/0053596 | A1 | 2/2016 | Rey | |
| 2016/0069857 | A1 | 3/2016 | Batarseh et al. | |
| 2016/0326839 | A1 | 11/2016 | Ayub et al. | |

FOREIGN PATENT DOCUMENTS

| | | | |
|---|---|---|---|
| WO | 2012038814 | A2 | 3/2012 |
| WO | 2014011385 | A1 | 1/2014 |
| WO | 2015009807 | A2 | 1/2015 |
| WO | 2016179132 | A1 | 11/2016 |

* cited by examiner

DOWNHOLE HEAT ORIENTATION AND CONTROLLED FRACTURE INITIATION USING ELECTROMAGNETIC ASSISTED CERAMIC MATERIALS

BACKGROUND

Field of the Disclosure

Generally, this disclosure relates to enhanced oil recovery. More specifically, this disclosure relates to electromagnetic assisted ceramic materials for directed and controlled downhole fracturing.

Background of the Disclosure

Enhanced oil recovery relates to techniques to recover additional amounts of crude oil from reservoirs. Enhanced oil recovery focuses on recovery of reservoir heavy oil and aims to enhance flow from the formation to the wellbore for production. For example, thermal fracturing can be used to create a fracture network. Thermal fracturing occurs as a result of temperature-induced changes in rock stress in the near wellbore region and can increase secondary permeability in production rock. However, it can be a challenge to orient and control the propagation of the fracture network with current technology.

Electromagnetic wave technology has potential in heavy oil recovery by lowering the viscosity of the heavy oil or for reducing or removing condensate blockage. However, prior attempts at using electromagnetic wave technology downhole have had limited success due to limited heat penetration depth (such as a few feet near the wellbore) and low efficiency in generating enough energy for commercial production.

SUMMARY

Embodiments disclosed herein provide systems and methods for orienting fractures within a subterranean formation. Electromagnetic wave energy is used to heat ceramic material and the heat generated causes the formation to fracture. The orientation of the fractures can be directed by the placement of a source tool and ceramic-containing material within the wellbore. This is especially useful in hydrocarbon wells where fracture orientation is critical for maximum recovery.

In an embodiment of this application a fracturing assembly for forming fractures in a subterranean formation. The fracturing assembly includes a source tool having a rotational joint moveable to orient the source tool in a range of directions and a directional electromagnetic antenna having an electromagnetic wave source. A ceramic-containing member is located within a distance of the electromagnetic antenna configured to be heated to a fracture temperature by electromagnetic waves produced by the electromagnetic wave source. The ceramic-containing member is positionable to orient a fracture in the subterranean formation when the ceramic-containing member is heated to at the fracture temperature.

In alternate embodiments, the ceramic-containing member can be an outer casing attached to the source tool. A rotational orientation head can be moveable to orient the outer casing relative to the source tool. Alternately, the ceramic-containing member can be a gravel packing or a proppant positioned adjacent to the subterranean formation.

In other alternate embodiments, a latching assembly can be moveable to a latched position preventing movement of the rotational joint. The electromagnetic waves produced by the electromagnetic wave source can have a wavelength in a range of a microwave or radio frequency wave. A geophone can be operable to monitor the fracture in the subterranean formation formed by the ceramic-containing member at the fracture temperature. A cable attached to a motor associated with the rotational joint can provide power and communication for an orientation of the source tool in the range of directions.

In an alternate embodiment of this disclosure, a system for forming fractures in a subterranean formation with a fracturing assembly includes locating a source tool within a wellbore and having a rotational joint moveable to orient the source tool in a range of directions, and a directional electromagnetic antenna having an electromagnetic wave source. A ceramic-containing member is located within the wellbore and positioned to orient a fracture in the subterranean formation when heated to a fracture temperature. The source tool is oriented to direct electromagnetic waves produced by the electromagnetic wave source towards the ceramic-containing member to heat the ceramic-containing member to the fracture temperature.

In alternate embodiments, the source tool can be supported by a tubing extending into the wellbore and can be rotatable relative to the tubing. The ceramic-containing member can be an outer casing attached to the source tool with a rotational orientation head operable to rotate the outer casing relative to the source tool, the outer casing including regions of concentrated ceramic material and the rotational orientation head being operable to rotate the outer casing to position the regions of concentrated ceramic material to orient the fracture in the subterranean formation. Alternately, the ceramic-containing member can be one of a gravel packing or a proppant positioned within the wellbore adjacent to the subterranean formation. A motor and a cable can provide power and communication for an orientation of the source tool in the range of directions.

In another embodiment of this disclosure, a method for forming fractures in a subterranean formation with a fracturing assembly includes providing a source tool having a rotational joint moveable to orient the source tool in a range of directions and a directional electromagnetic antenna having an electromagnetic wave source. A ceramic-containing member is located within a distance of the electromagnetic antenna to enable the ceramic-containing member to be heated to a fracture temperature by electromagnetic waves produced by the electromagnetic wave source. The ceramic-containing member is positioned to orient a fracture in the subterranean formation at the fracture temperature.

In alternate embodiments, the ceramic-containing member can be an outer casing attached to the source tool and the method can further include moving a rotational orientation head of the outer casing to orient the outer casing relative to the source tool. The outer casing can include regions of concentrated ceramic material, and the method can further include rotating the outer casing with the rotational orientation head to position the regions of concentrated ceramic material to orient the fracture in the subterranean formation.

In other alternate embodiments, the ceramic-containing member can be one of a gravel packing and a proppant, and the method can further include positioning the ceramic-containing member adjacent to the subterranean formation. A latching assembly can be moved to a latched position, preventing movement of the rotational joint. Electromagnetic waves having a wavelength in a range of a microwave or radio frequency wave can be produced. The source tool can be supported with a tubing extending into a wellbore, the source tool being rotatable relative to the tubing.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION OF THE DISCLOSURE

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
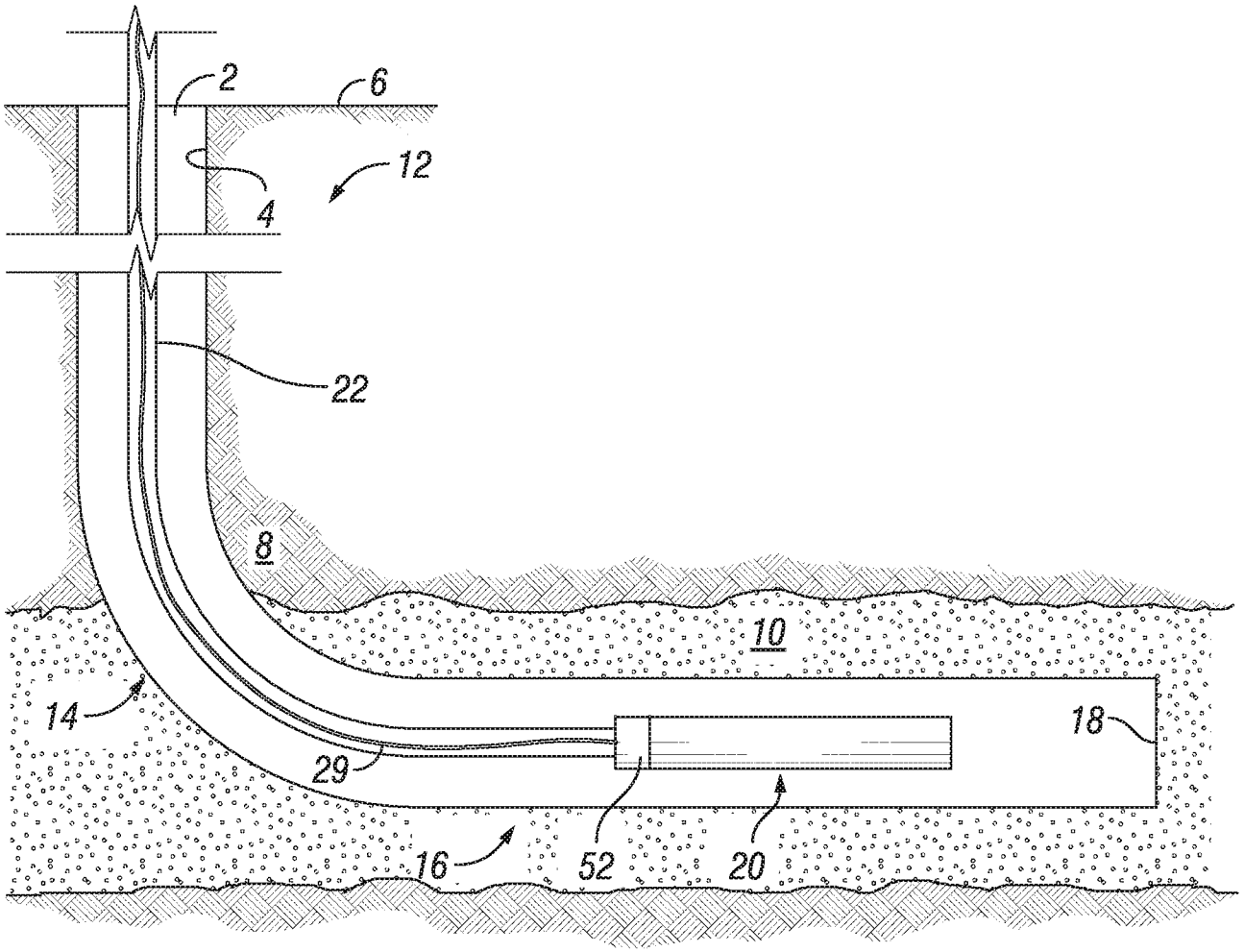
FIG. 1 is general schematic section view of a subterranean well having a fracturing assembly according to embodiments of the disclosure.

Looking at FIG. 1, wellbore 2 is a space defined by wellbore wall 4. Wellbore 2 forms a fluid pathway that extends from surface 6, through non-hydrocarbon bearing formation 8 and into hydrocarbon-bearing formation 10. Wellbore 2 has several sections, including vertical run 12, transition zone 14 and horizontal section 16. Horizontal section 16 extends in a generally horizontal direction from transition zone 14 until reaching the distal end of wellbore 2, which is wellbore face 18. Wellbore 2 contains wellbore fluid. Fracturing assembly 20 is located within wellbore 2. In FIG. 1, fracturing assembly 20 is located in horizontal section 16. However, fracturing assembly 20 can alternately be located in vertical run 12 or transition zone 14, depending on the location of hydrocarbon-bearing formation 10 and the location of region where fracturing to increase the secondary permeability is desired, for example, for establishing communications between wellbore 2 and hydrocarbon-bearing formation 10 to improve production. Fracturing assembly 20 can be used to form fractures in subterranean hydrocarbon-bearing formation 10.

Figure 2:
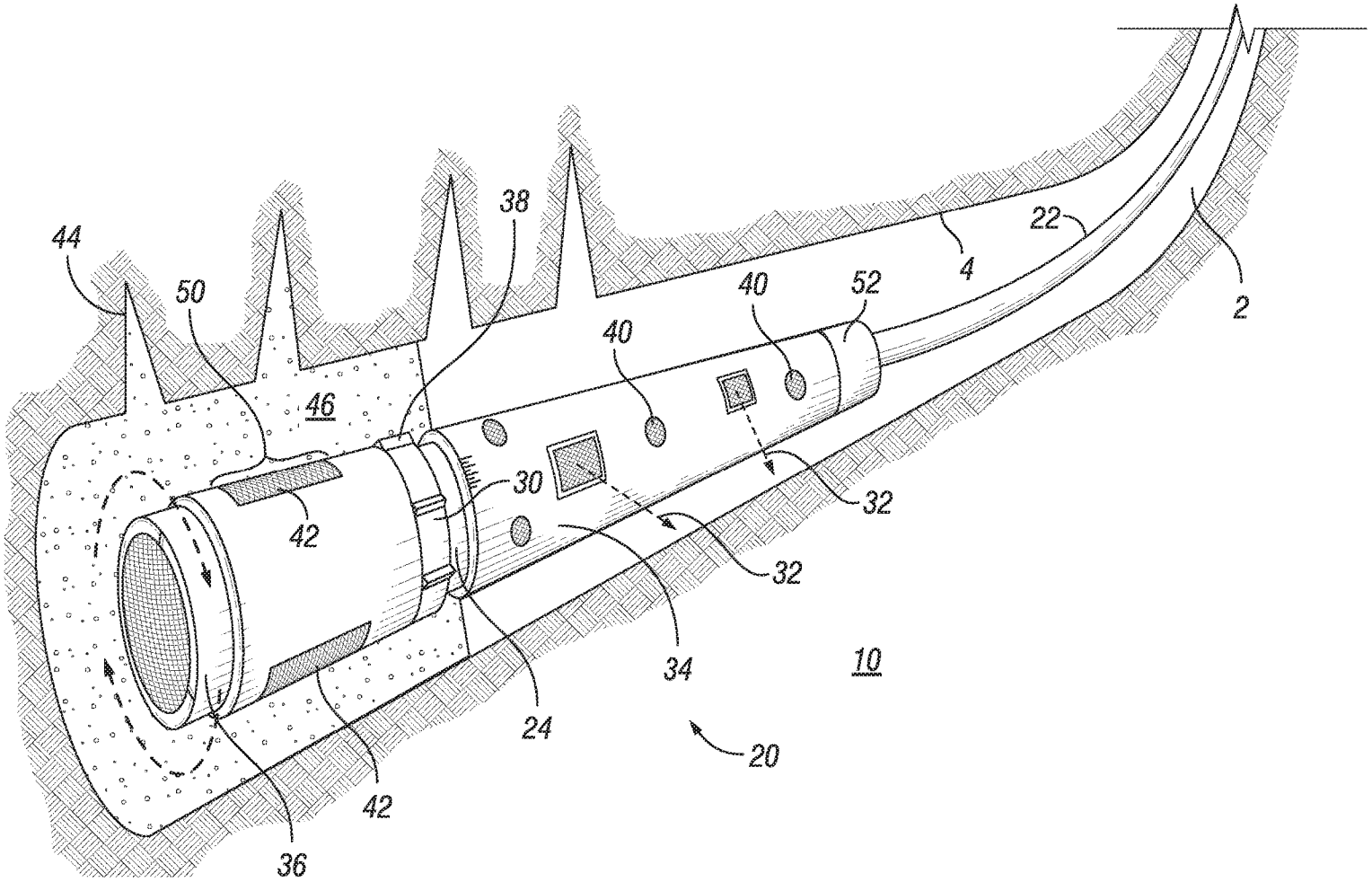
FIG. 2 is a schematic partial section view of a fracturing assembly according to embodiments of the disclosure.
Figure 3:
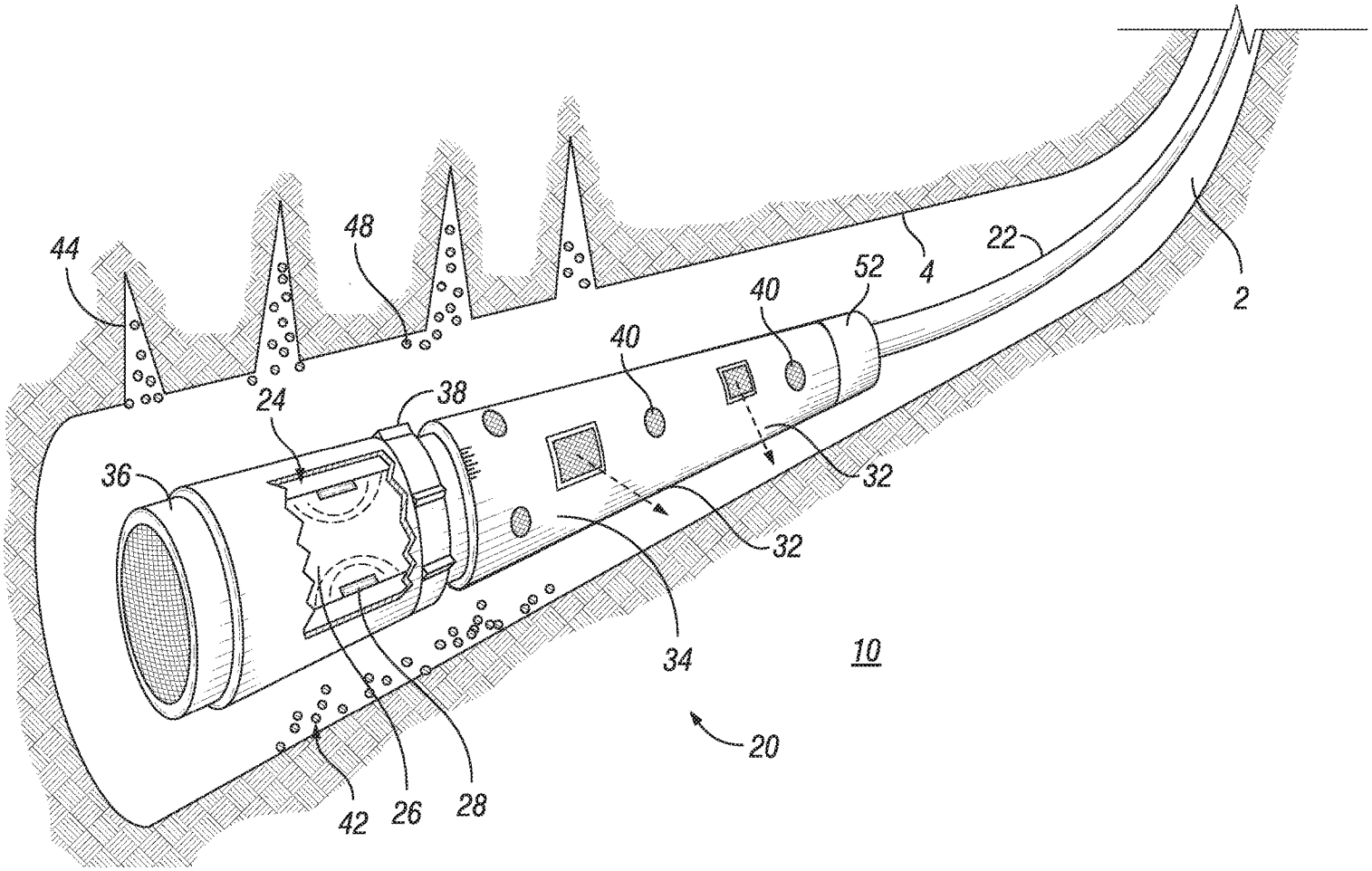
FIG. 3 is a schematic partial section view of a fracturing assembly according to alternate embodiments of the disclosure.

Looking at FIGS. 2-3, fracturing assembly 20 can be lowered into wellbore 2 on tubing 22. Tubing 22 extends into wellbore 2 and supports fracturing assembly 20 within wellbore 2. Tubing 22 can be, for example, a string of joints or a length or coiled tubing, or other known tubular members used in wellbores.

Fracturing assembly 20 can include source tool 24. Source tool 24 includes directional electromagnetic antenna 26. Electromagnetic antenna 26 includes one or more electromagnetic wave source 28 (FIG. 3). Electromagnetic wave source 28 can direct electromagnetic waves produced by electromagnetic wave source 28 radially outwards in a direction towards wellbore wall 4. In certain embodiments electromagnetic wave source 28 can be excited based on signals from the surface. Electromagnetic wave source 28 can be excited wirelessly or can be hard wired, for example by way of cable 29 (FIG. 1). Electromagnetic wave source 28 can produce an electromagnetic wave having a wavelength in the range of a microwave, a radio frequency wave, or in the range of a microwave to radio frequency wave. For example, electromagnetic wave source 28 can produce an electromagnetic wave having a wavelength in the range of 3 MHz to 300 MHz, in the range of 300 MHz to 300 GHz, or in the range of 3 MHz to 300 GHz.

Electromagnetic antenna 26 can be a custom directional antenna that can focus the beam in a particular direction, such as towards a desired target. Such a custom directional antenna can provide an efficient means for directing electromagnetic waves towards ceramic containing member 42 without wasting energy. In alternate embodiments, a currently available industrial downhole electromagnetic antenna 26 can be used that provides a less focused beam.

Rotational joint 30 allows for the orientation of source tool 24 in a range of directions. Rotational joint 30 allows source tool 24 to be rotated within wellbore 2 so that electromagnetic wave source 28 is directed towards the region of hydrocarbon-bearing formation 10 to be fractured. Rotational joint 30 can allow for relative rotation between source tool 24 and tubing 22. As an example, rotational joint 30 can include a thrust and roller bearing to provide for rotation of source tool 24. Rotational joint 30 could alternately include a ball type joint or other known rotating mechanism that can rotate and otherwise orient source tool 24 within wellbore 2. When source tool 24 is positioned, rotated, and otherwise oriented within wellbore 2 as desired, latching assembly 32 can be moved to a latched position to prevent further movement of rotational joint 30 and fix the orientation of source tool 24.

Source tool 24 can be located within outer casing 34 of fracturing assembly 20. Outer casing 34 can be attached to source tool 24 at rotational orientation head 36. Rotational orientation head 36 is moveable to orient outer casing 34 relative to source tool 24. Rotational orientation head 36 can allow for outer casing 34 to rotate a full three hundred and sixty degrees about the longitudinal axis of fracturing assembly 20.

Centralizer 38 can be used to centralize fracturing assembly 20 within wellbore 2. Centralizer 38 can be of a known shape and form and can help to prevent fracturing assembly 20 from contacting wellbore wall 4 so that fracturing assembly 20 is not damaged on wellbore wall 4 and so that fracturing assembly 20 moves efficiently in and out of wellbore 2.

Fracturing assembly 20 can also include acoustic capabilities including transducers and geophones 40 to monitor and record the sound coming from the fracturing and cracking. These sounds can indicate the operation success and functionality, by estimating fracture length and size. A set of purging nozzles (not shown) can be added for cleaning, purging and controlling the material coming out from the formation. Certain surfaces of fracturing assembly 20, such as portions of source tool 24 and outer casing 34 can be formed of a material that can contain electromagnetic waves and high heat. As an example, a bottom end of fracturing assembly 20 can include a reinforced plug.

Looking at FIGS. 1-2, a ceramic-containing member 42 can be located within a distance of electromagnetic antenna 26 (FIG. 3) to be heated to a fracture temperature by electromagnetic waves produced by electromagnetic wave source 28. Ceramic-containing member 42 can be positioned to orient a fracture 44 in hydrocarbon-bearing formation 10 when ceramic-containing member 42 reaches a fracture temperature by thermal fracturing. Thermal fracturing occurs as a result of temperature-induced changes in rock stress. In alternate embodiments, ceramic-containing member 42 can be outer casing 34 (FIG. 2), gravel packing 46 (FIG. 2), proppant 48 (FIG. 3), or a combination thereof.

The ceramic materials used in ceramic-containing member 42 can have unique characteristics that allow ceramic-containing member 42 to heat up when exposed to electromagnetic waves. In certain embodiments, ceramic-containing member 42 can be heated to at least about 1000° C. when exposed to electromagnetic waves from electromagnetic wave source 28, which will cause fractures in the direction of the orientation of electromagnetic wave source 28 and ceramic-containing member 42. Fracture propagation is a function of rock type and stress orientations and some fractures can be initiated by an increase of 25° C. or more of in-situ temperature. Alternately, fractures can be initiated by increasing the water temperature in the formation to boiling temperature so that the resulting steam expansion initiates fractures.

In certain embodiments, the ceramic materials heat within minutes, such as less than about 5 minutes. In alternate embodiments, the ceramic materials heat in less than about 3 minutes. The sudden increase in temperature, causes an instant temperature increase in the rock of hydrocarbon-bearing formation 10, which can reach temperatures of up to 1000° C., resulting in thermal shocking of hydrocarbon-bearing formation 10, creating micro fractures.

Earth ceramic materials have been identified and successfully evaluated and tested for potential usage due to their unique characteristics in heating up rapidly reaching 1000° C. when exposed to electromagnetic waves. Such materials also can have flexibility to be molded and formed in any shape and size needed. In addition, such materials can be very durable and be beneficial for a number of years of use within wellbore 2.

In certain embodiments, the ceramic materials include ceramic materials obtained from Advanced Ceramic Technologies, such the CAPS, B-CAPS, C-CAS AND D-CAPS products. These products are generally natural clays that include silica, alumina, magnesium oxide, potassium, iron III oxide, calcium oxide, sodium oxide, and titanium oxide.

When outer casing 34 is a ceramic-containing member 42, outer casing 34 can include regions of concentrated ceramic material 50. The ceramic particles used for regions of concentrated ceramic material 50 can include any of the ceramic materials described in this disclosure. Rotational orientation head 36 can be used to rotate outer casing 34 to position regions of concentrated ceramic material 50 of outer casing 34 adjacent to the region of hydrocarbon-bearing formation 10 to be fractured.

Motor 52 can be used to move both rotational joint 30 and rotational orientation head 36. Cable 29 (FIG. 1) can be attached to motor 52 for providing power and communication for the orientation of source tool 24 in a range of directions of rotational joint 30 and rotational orientation head 36. In the example of FIG. 1, cable 29 extends within tubing 22. In alternate embodiments, cable 29 can extend external of tubing 22.

Looking at FIG. 2, in alternate embodiments where ceramic-containing member 42 is a gravel packing 46, gravel packing 46 is positioned adjacent to subterranean hydrocarbon-bearing formation 10 where fractures 44 are desired. Gravel packing 46 will be oriented within wellbore 2 to achieve the desired orientation of fracture 44. Gravel packing is traditionally used to control sand production. A suitable particle size for the ceramic material for use as a gravel packing, and an advantageous ratio of ceramic material to gravel, or similar rock mixes, can be determined The suitable ratio of ceramic material to gravel, or similar rock mixes will allow ceramic-containing member 42 to be quickly heated as described above to at least about 1000° C. The ceramic particles used for gravel packing 46 can include any of the ceramic materials described in this disclosure.

Looking at FIG. 3, in alternate embodiments ceramic-containing member 42 can be proppant 48. Proppant 48 that includes ceramic particles can be used for fracturing. The ceramic particles used for proppant 48 can include any of the ceramic materials described in this disclosure. Proppant 48 can be used in a fluid carrier or positioned within wellbore 2 with other known techniques. The ceramic particles that are injected can improve heat penetration and energy efficiency compared to alternate techniques as the ceramic particles can travel farther from the wellbore 2. Proppant 48 can be injected to be positioned adjacent to subterranean hydrocarbon-bearing formation 10 where fractures 44 are desired, and oriented within wellbore 2 to achieve the desired orientation of fracture 44.

The ceramic particles can range in sizes from micrometers to millimeters. Generally, the particles range from less than 2 micrometers to about 2500 micrometers. In some embodiments, the ceramic particles range in size from about 106 micrometers to 2.36 millimeter. In some embodiments, such as for fine ceramic particles, the ceramic particles are less than 2 micrometers. In some embodiments, the particles are of uniform size. In other embodiments, the particles are not of uniform size. The injection of proppant 48 having ceramic particles is of particular use in tight formations.

In an example of operation source tool 24 can be lowered into wellbore 2. Source tool 24 can be lowered with, and supported by, tubing 22. Rotational joint 30 can be moved to orient source tool 24 so that electromagnetic wave source 28 is directed towards the region of hydrocarbon-bearing formation 10 to be fractured. Ceramic-containing member 42 can be located within wellbore 2 within a distance from electromagnetic antenna 26 to enable ceramic-containing member 42 to be heated to a fracture temperature by electromagnetic waves produced by electromagnetic wave source 28. Ceramic-containing member 42 is positioned to orient fracture 44 in hydrocarbon-bearing formation 10 when ceramic-containing member 42 is at the fracture temperature.

When ceramic-containing member 42 is outer casing 34, rotational orientation head 36 can be used to rotate outer casing 34 to position regions of concentrated ceramic material 50 of outer casing 34 adjacent to the region of hydrocarbon-bearing formation 10 to be fractured. When ceramic-containing member 42 is gravel packing 46 or proppant 48, gravel packing 46 or proppant 48, as applicable, is positioned adjacent to subterranean hydrocarbon-bearing formation 10 where fractures 44 are desired. For example, there may be a particular location of fracture within hydrocarbon-bearing formation 10 that would allow for improved communication and flow between the wellbore 2 and hydrocarbon-bearing formation 10 that would bypass wellbore damaged zones. The orientation of electromagnetic wave source 28 and ceramic-containing member 42 can be selected to form fractures 44 is such a location. For example, when electromagnetic wave source 28 is directed towards ceramic-containing member 42, a fracture will tend to form along a generally straight line that would pass through electromagnetic wave source 28 and ceramic-containing member 42.

In order to generate fractures 44, electromagnetic wave source 28 directs electromagnetic waves towards ceramic-containing member 42 which is rapidly heated to the fracture temperature, resulting in thermal shocking of hydrocarbon-bearing formation 10, creating fractures 44. Transducers and geophones 40 can monitor the fracture in the subterranean formation formed by the ceramic-containing member being heated to the fracture temperature. After fractures 44 are formed, source tool 24 can be removed from wellbore 2 with tubing 22.

Experimental Studies

In order to determine the ability to direct and orientation of fractures within subterranean formations, laboratory experiments were performed. Looking at FIG. 4A, in a first example, a representative wellbore 54A is drilled in a sandstone rock sample 56A and the representative wellbore 54A is filled with ceramic material 58A. The ceramic material 58A was exposed to electromagnetic waves for 3 minutes. Random fractures 60A forming in the sandstone rock sample 56A propagate in random directions that are roughly 90 degree angles from each other.

Figure 4B:
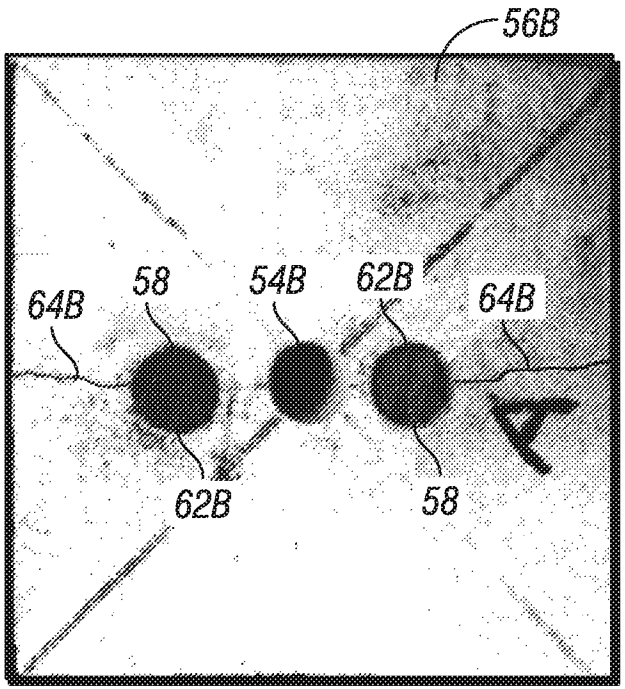
FIGS. 4A-4B are photographs of rock samples from experimental studies.
Figure 4A:
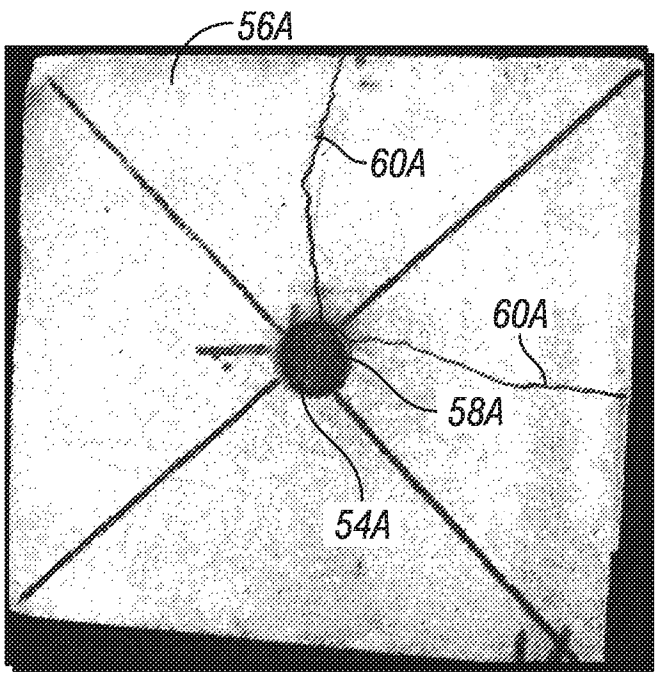

Looking at FIG. 4B, a representative wellbore 54B is drilled in a sandstone rock sample 56A. Secondary bores 62B are formed adjacent to representative wellbore 54B and are filled with ceramic material 58B. These secondary bores 62B emulate spaces adjacent to representative wellbore 54B being supplied with a ceramic-containing member. The ceramic material 58B was exposed to electromagnetic waves for 3 minutes. Directed fractures 64B forming in the sandstone rock sample 56B propagate in a direction roughly along a straight line that would connect representative wellbore 54B with secondary bores 2B.

Embodiments of this disclosure therefore provide technology establishing communications between wellbore 2 and hydrocarbon-bearing formation 10 to improve production by utilizing a electromagnetic energy with ceramic materials in wellbore 2, without causing wellbore formation damage, such as blockages. Combining ceramic materials with electromagnetic radiation technology allows for improved heat distribution and cost effective recovery methods. Due to the unique ceramic properties, the temperature generated by ceramic materials when exposed to the electromagnetic wave energy can reach up to 1000° C. Embodiments of this disclosure provide a heating mechanism to create controlled oriented fractures to enhance communication and flow between the wellbore and formation that can bypass wellbore damaged zones.

Although the present disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

As used herein and in the appended claims, the words "comprise," "has," and "include" and all grammatical variations thereof are each intended to have an open, non-limiting meaning that does not exclude additional elements or steps.

What is claimed is:

1. A fracturing assembly for forming fractures in a subterranean formation, the fracturing assembly comprising:

a source tool having a rotational joint moveable to orient the source tool in a range of directions and a directional electromagnetic antenna having an electromagnetic wave source; and a ceramic-containing member located within a distance of the electromagnetic antenna configured to be heated to a fracture temperature by electromagnetic waves produced by the electromagnetic wave source; wherein the ceramic-containing member is positionable to orient a fracture in the subterranean formation when the ceramic-containing member is heated to the fracture temperature.

2. The fracturing assembly of claim 1, wherein the ceramic-containing member is an outer casing attached to the source tool.

3. The fracturing assembly of claim 2, further including a rotational orientation head moveable to orient the outer casing relative to the source tool.

4. The fracturing assembly of claim 1, wherein the ceramic-containing member is one of a gravel packing and a proppant positioned adjacent to the subterranean formation.

5. The fracturing assembly of claim 1, further including a latching assembly moveable to a latched position preventing movement of the rotational joint.

6. The fracturing assembly of claim 1, wherein the electromagnetic waves produced by the electromagnetic wave source have a wavelength in a range of a microwave or radio frequency wave.

7. The fracturing assembly of claim 1, further including a geophone operable to monitor the fracture in the subterranean formation formed by the ceramic-containing member at the fracture temperature.

8. The fracturing assembly of claim 1, further including a cable attached to a motor associated with the rotational joint and providing power and communication for an orientation of the source tool in the range of directions.

9. A system for forming fractures in a subterranean formation with a fracturing assembly, the system comprising:

a source tool located within a wellbore and having a rotational joint moveable to orient the source tool in a range of directions, and a directional electromagnetic antenna having an electromagnetic wave source; and a ceramic-containing member located within the wellbore and positioned to orient a fracture in the subterranean formation when heated to a fracture temperature; wherein the source tool is oriented to direct electromagnetic waves produced by the electromagnetic wave source towards the ceramic-containing member to heat the ceramic-containing member to the fracture temperature.

10. The system of claim 9, wherein the source tool is supported by a tubing extending into the wellbore and is rotatable relative to the tubing.

11. The system of claim 9, wherein the ceramic-containing member is an outer casing attached to the source tool with a rotational orientation head operable to rotate the outer casing relative to the source tool, the outer casing including regions of concentrated ceramic material and the rotational orientation head being operable to rotate the outer casing to position the regions of concentrated ceramic material to orient the fracture in the subterranean formation.

12. The system of claim 9, wherein the ceramic-containing member is one of a gravel packing and a proppant positioned within the wellbore adjacent to the subterranean formation.

13. The system of claim 9, further including a motor and a cable providing power and communication for an orientation of the source tool in the range of directions.

14. A method for forming fractures in a subterranean formation with a fracturing assembly, the method comprising:

providing a source tool having a rotational joint moveable to orient the source tool in a range of directions and a directional electromagnetic antenna having an electromagnetic wave source;

locating a ceramic-containing member within a distance of the electromagnetic antenna to enable the ceramic-containing member to be heated to a fracture temperature by electromagnetic waves produced by the electromagnetic wave source; and positioning the ceramic-containing member to orient a fracture in the subterranean formation at the fracture temperature.

15. The method of claim 14, wherein the ceramic-containing member is an outer casing attached to the source tool, the method further including moving a rotational orientation head of the outer casing to orient the outer casing relative to the source tool.

16. The method of claim 15, wherein the outer casing includes regions of concentrated ceramic material, the method further including rotating the outer casing with the rotational orientation head to position the regions of concentrated ceramic material to orient the fracture in the subterranean formation.

17. The method of claim 14, wherein the ceramic-containing member is one of a gravel packing and a proppant, the method further including positioning the ceramic-containing member adjacent to the subterranean formation.

18. The method of claim 14, further including moving a latching assembly to a latched position, preventing movement of the rotational joint.

19. The method of claim 14, further including producing electromagnetic waves having a wavelength in a range of a microwave or radio frequency wave.

20. The method of claim 14, further including supporting the source tool with a tubing extending into a wellbore, the source tool being rotatable relative to the tubing.

* * * * *